US006986213B2

(12) United States Patent
Kruithof et al.

(10) Patent No.: US 6,986,213 B2
(45) Date of Patent: Jan. 17, 2006

(54) METHOD FOR DRYING FINELY DIVIDED SUBSTANCES

(75) Inventors: Arjen Johannes Kruithof, Nijmegen (NL); Pieter Jan W. Blom, Apeldoorn (NL); Paulus Statius R. Kosters, Apeldoorn (NL); Paulus Josephus T. Bussmann, Apeldoorn (NL)

(73) Assignee: Nederlandse Organisatie voor toegepast-natuurwetenschappelijk Onderzoek TNO, VK Delft (NL)

( * ) Notice: Subject to any disclaimer, the term of this patent is extended or adjusted under 35 U.S.C. 154(b) by 94 days.

(21) Appl. No.: 10/296,469

(22) PCT Filed: May 23, 2001

(86) PCT No.: PCT/NL01/00394

§ 371 (c)(1),
(2), (4) Date: Jul. 2, 2003

(87) PCT Pub. No.: WO01/90669

PCT Pub. Date: Nov. 29, 2001

(65) Prior Publication Data

US 2004/0040173 A1 Mar. 4, 2004

(30) Foreign Application Priority Data

May 25, 2000 (NL) ..... 1015310
Dec. 18, 2000 (NL) ..... 1016895

(51) Int. Cl.
*F26B 3/00* (2006.01)

(52) U.S. Cl. ..... 34/330; 34/333

(58) Field of Classification Search ..... 349/329, 349/330, 331, 332, 333
See application file for complete search history.

(56) References Cited

U.S. PATENT DOCUMENTS

| | | | | |
|---|---|---|---|---|
| 2,882,243 | A | 4/1959 | Milton | |
| 3,623,233 | A | 11/1971 | Severinghaus | |
| 5,577,333 | A * | 11/1996 | Shick et al. | 34/360 |

FOREIGN PATENT DOCUMENTS

| | | |
|---|---|---|
| BE | 455 421 | 5/1944 |
| DE | 36 27 751 | 2/1988 |
| GB | 569 710 | 1/1946 |
| JP | 56 161900 | 12/1981 |
| JP | 362122570 | * 6/1987 |

* cited by examiner

*Primary Examiner*—Kenneth Rinehart
(74) *Attorney, Agent, or Firm*—Young & Thompson

(57) ABSTRACT

A method for drying a granular solid, the finely divided solid to be dried being mixed with zeolite granules, after which drying takes place by removal of water from the solid. The solid dried by removal of moisture is then separated from the zeolite. According to the invention, the solid to be dried is dried in a mixer without external supply of heat, after which the dried solid is at least virtually completely separated from the zeolite granules after a residence time in the mixer. This is advantageous in particular when drying foods, such as wheat flour.

19 Claims, No Drawings

METHOD FOR DRYING FINELY DIVIDED SUBSTANCES

The invention relates to a method for drying a granular solid, the solid to be dried being mixed with zeolite granules, after which drying takes place through removal of water from the solid by the zeolite and the solid dried by removal of moisture is separated from the zeolite.

A method of this type is disclosed in WO 002822 A1, which describes how an aqueous substance is processed by mixing with zeolite, which mixture is then heated so that drying of the mixture occurs, after which a partial separation of the zeolite and the dried product is effected in such a way that the quantity of off-gas is limited.

A disadvantage of the method according to the prior art is that the mixture to be dried has to be heated in order to achieve an adequate degree of drying. Drying processes according to the prior art involve conductive or convective drying of the product.

Conductive drying makes use, for example, of a tumble, paddle or conical dryer. The product is dried by introducing heat via conduction. As a consequence of the lack of heat transfer and the usually hygroscopic nature of the material to be dried, a relatively long drying time, of the order of 6 to 16 hours, is needed. The external supply of energy to the drying process is expensive and the high temperate that is achieved by the external supply of energy can damage or degrade the substance to be dried.

When convective drying is used, the product to be dried is entrained in a hot gas stream and after drying is separated off in a cyclone or fabric filter. A disadvantage of convective drying is the high energy consumption of the drying installation. It is also a disadvantage that the installation is relatively large. The fact that the product to be dried must be able to be fluidised well in order to be transported well by the hot gas stream constitutes a further disadvantage.

The known drying installations are also relatively complex and these include steam, hot water or cooling circuits. A vacuum pump and a condenser in general also form part of the installations that are used for carrying out drying in accordance with the prior art.

One aim of the present invention is to provide a method for drying a granular solid with which a very low moisture content is achieved in an energy-efficient manner within a short time. A further aim is to provide a method that can be carried out with a relatively simple and compact installation.

Said aim is achieved in that the solid to be dried is dried in a mixer without external supply of heat and in that the dried solid is at least virtually completely separated from the zeolite granules, preferably Linde type A zeolite granules, after a residence time in the mixer. Drying of the solid without external supply of heat has the advantage that a considerable saving in energy costs is achieved. Moreover, at least virtually no damage or degradation as a result of heating or combustion of the solid to be dried occurs since the temperature at which the solid to be dried is damaged or degraded is not exceeded. It has been found that final moisture content of 4% can be obtained when drying finely divided solids, such as flour. These final moisture contents can be lower when drying chemical products. As a result of the use of the method according to the present invention, the temperature is kept below the critical value, which is at most 60° C. for protein-containing substances and at most 40° C. for thermally unstable substances, a limited rise in temperature as a result of adsorption of heat by the zeolite being possible.

In a simple mixer the residence time of the solid to be dried is less than 1 hour, preferably less than 0.5 hour and more preferentially less than 10 minutes. Such low residence times are achieved as a result of the high water absorbency of the zeolite granules. The consequence of this is that hygroscopic or thermally usable granular solids can also be dried using the method according to the invention. The hygroscopic or thermally unstable solids can comprise finely divided organic and inorganic compounds or mixtures of compounds, such as, for example, crystalline or amorphous chemicals, salts, granular polymers, amorphous powders or granules, foods, such as flour products, proteins and carbohydrates and living cells such as bacterial and yeast cultures. However, this list is not exhaustive.

Preferably, the method according to the present invention is provided with a cleaning step for the zeolite granules. The purpose of this cleaning step is to separate the very fine zeolite particles which adhere to the zeolite granules from the zeolite granules in order to prevent product contamination. This has to be carried out once before the zeolite is used for the first time. A suitable cleaning step comprises, for example, a fluidisation treatment, a rinsing operation with a suitable liquid or a mixing step with a suitable finely divided solid. The proportion of fine zeolite particles is preferably reduced to at most 0.05% (m/m) in the dried finely divided substance.

In a preferred embodiment the zeolite granules are regenerated after separation from the dried finely divided substance and re-used. Product contamination remains limited to at most 0.03% (m/m). Product contamination also remains limited to at most 0.03% (m/m) in the case of regeneration and re-use of the zeolite granules. Regeneration of the zeolite granules and the use of fluidised bed mixing do not lead to an increase in the zeolite contamination.

Preferably, separation of the dried finely divided solid from the zeolite granules is based on a difference in particle size of the two substances. Care is taken that the particle size distribution of zeolite granules and the particle size distribution of the dried solid do not overlap or barely overlap one another, so that the two substances can be separated from one another in a simple manner, for example by means of a sieve with a predetermined mesh size. Preferably, the two particle size distributions overlap one another by at most 0.5% (m/m), and more preferentially at most 0.1% (m/m), to minimise product loss.

More preferentially, the zeolite granules are resistant to breaking. The breaking strength of the zeolite granules has at least an average value of 30 N, determined by a standard test method, such as IFP method R-28786. Preferably, this hardness value is higher, at a value of 80 N, likewise determined in accordance with this standard test method. The consequence of this is that the abovementioned separation by means of a sieve can take place in a simple manner. Zeolite granules which have an inadequate breaking strength fall apart, that part of the grain that has broken off having a particle size which is within the particle size distribution of the finely divided dried solid. Since the broken off material is not retained by the abovementioned sieve, the finely divided dried solid is contaminated with zeolite.

In a further preferred embodiment the finely divided solid to be dried is mixed with a predetermined quantity of zeolite, so that the ratio between the quality of finely divided substance to be dried and the quantity of zeolite has a fixed value, which fixed value is dependent on the characteristics of the finely divided substance to be dried and on the characteristics of the dried end product. For instance, the final moisture content in the finely divided solid to be dried is reduced when the set mixing ratio of solid to be dried to zeolite decreases.

According to a preferred embodiment, the method according to the present invention is in particular suitable for drying various types of flour, such as wheat flour, and other finely divided foods.

In a further embodiment, mixing of the zeolite granules with the solid to be dried, as well as the separation of the zeolite granules and the dried solid, takes place in a continuous process.

The various features are explained in more detail on the basis of the results of the experiments given below.

The experiments were carried out in a conical mixer. For each experiment the conical mixer was filled with zeolite granules and wheat flour in a specific mass ratio. During mixing of the two substances the temperature rises to some extent as a consequence of the liberation of heat of adsorption. This explains the rising temperature which was achieved during the mixing process. After the mixing time had elapsed, which during the experiment was 10 minutes, the zeolite granules and the wheat flour were separated using a sieve. This separation was carried out on the basis of the difference in particle size between the wheat flour and the zeolite granules. The results of the experiments are given in the table below.

| Mixing ratio flour:zeolite (kg/kg) | Initial moisture content of flour (%) | Mixing time (min) | Max. temperature (° C.) | Final moisture content of flour (%) |
|---|---|---|---|---|
| 4:1 | 13.6 | 10 | 31 | 10.9 |
| 4:2 | 13.7 | 10 | 39 | 8.1 |
| 4:3 | 13.4 | 10 | 42 | 6.4 |
| 4:4 | 13.6 | 10 | 48 | 4.1 |

It can be seen from the experiments that the final moisture content can be regulated by changing the ratio between the quantity of wheat flour and the quantity of zeolite granules. For a given quantity of wheat flour, a given initial moisture content and a given mixing time, a larger quantity of zeolite yields a lower final moisture content.

The separation efficiency was higher than 99.9% (m/m) during the experiment. Regeneration and re-use of the zeolite granules led to comparable results. After separation of the flour from the zeolite granules the zeolite content in the wheat flour end product was approximately 0.01% (m/m). The wheat flour content in the zeolite granules to be regenerated was less than 0.1% (m/m). Final moisture contents of 2.7% were achieved with drying times of one hour, after which a longer residence time showed no further decrease in the final moisture content.

The invention claimed is:

1. Method for drying a granular solid, comprising the steps of:

mixing a solid to be dried with zeolite granules;

after the mixing step, drying the solid by the zeolite removing water from the solid, the drying being in a mixer without application of an external supply of heat; and after a residence time in the mixer, at least virtually completely separating the dried solid from the zeolite, wherein, the zeolite granules are subjected to a cleaning step before the zeolite granules are mixed with the finely divided solid.

2. Method according to claim 1, wherein, the mass ratio of solid to zeolite is between 20:1 and 1:1.

3. Method according to claim 2, wherein, the zeolite granules are regenerated after separation from the dried finely divided substance and re-used.

4. Method according to claim 1, wherein, the zeolite granules are regenerated after separation from the dried finely divided substance and re-used.

5. Method according to claim 1, wherein, the average size of the zeolite granule is between 1 mm and 10 mm, the average particle size of the granular solid being less than 1,000 micrometers, the ratio of the average particle size of the zeolite to that of the solid being between 1 and 10,000.

6. Method according to claim 5, wherein, the particle size distribution of the zeolite granules overlaps the particle size distribution of the solid by less than 0.5% (m/m).

7. Method according to claim 1, wherein, the ratio between the quantity of finely divided substance to be dried and the quantity of zeolite has a fixed value, which fixed value is dependent on the characteristics of the finely divided substance to be dried.

8. Method according to claim 1, wherein, the mass ratio of solid to zeolite is between 20:1 and 1:1.

9. Method according to claim 1, wherein, the zeolite granules are regenerated after separation from the dried finely divided substance and re-used.

10. Method according to claim 1, wherein, the solid to be dried is flour.

11. Method according to claim 1, wherein, moisture removal is effected down to a final moisture content of 0.1%.

12. Method according to claim 1, wherein, the temperature in the mixer is lower than the degradation temperature of the solid to be dried.

13. Method according to claim 1, wherein, the residence time in the mixer is less than 1 hour.

14. Method according to claim 1, wherein, the zeolite has a breaking strength which is greater than 30 N.

15. Method according to claim 1, wherein, the mixing and separation of zeolite granules is a continuous process.

16. Method according to claim 1, wherein, the mass ratio of solid to zeolite is between 10:1 and 1:1.

17. Method according to claim 1, wherein, the mass ratio of solid to zeolite is between 5:1 and 1:1.

18. Method according to claim 1, wherein, the temperature in the mixer is between 20° C. and 50° C.

19. Method for drying a granular solid, comprising the steps of:

cleaning zeolite granules;

mixing a finely divided solid to be dried with the cleaned zeolite granules;

after the mixing step, drying the solid by the zeolite removing water from the solid, the drying being in a mixer without application of an external supply of heat; and after a residence time in the mixer, at least virtually completely separating the dried solid from the zeolite.

* * * * *